US009240165B2

(12) United States Patent
Bae et al.

(10) Patent No.: US 9,240,165 B2
(45) Date of Patent: Jan. 19, 2016

(54) DISPLAY DRIVER INTEGRATED CIRCUIT INCLUDING FIRST-IN-FIRST-OUT (FIFO) MEMORIES CONFIGURED TO RECEIVE DISPLAY DATA FROM A DISTRIBUTOR AND OUTPUT THE DISPLAY DATA TO GRAPHICS MEMORIES A DISPLAY SYSTEM HAVING THE SAME, AND A DISPLAY DATA PROCESSING METHOD THEREOF

(71) Applicant: SAMSUNG ELECTRONICS CO., LTD., Suwon-si, Gyeonggi-do (KR)

(72) Inventors: Jong-Kon Bae, Seoul (KR); Dokyung Kim, Gyeonggi-do (KR); Chulho Kim, Gyeonggi-do (KR); Junho Park, Gyeonggi-do (KR); Sooyoung Woo, Gyeonggi-do (KR); Chiho Cha, Gyeonggi-do (KR); Jeung Hwan Lee, Gyeonggi-do (KR)

(73) Assignee: SAMSUNG ELECTRONICS CO., LTD., Suwon-Si, Gyeonggi-Do (KR)

( * ) Notice: Subject to any disclaimer, the term of this patent is extended or adjusted under 35 U.S.C. 154(b) by 78 days.

(21) Appl. No.: 13/785,832

(22) Filed: Mar. 5, 2013

(65) Prior Publication Data

US 2014/0085321 A1 Mar. 27, 2014

(30) Foreign Application Priority Data

Sep. 24, 2012 (KR) ..... 10-2012-0105823

(51) Int. Cl.

| | |
|---|---|
| ***G09G 5/39*** | (2006.01) |
| ***G09G 5/00*** | (2006.01) |
| ***G09G 5/393*** | (2006.01) |
| *G09G 5/18* | (2006.01) |

(52) U.S. Cl.

CPC ..... *G09G 5/39* (2013.01); *G09G 5/006* (2013.01); *G09G 5/393* (2013.01); *G09G 5/18* (2013.01); *G09G 2370/08* (2013.01)

(58) Field of Classification Search

CPC ..... G09G 5/39
USPC ..... 345/558
See application file for complete search history.

(56) References Cited

U.S. PATENT DOCUMENTS

| | | | | |
|---|---|---|---|---|
| 5,818,464 | A | 10/1998 | Wade | |
| 6,002,412 | A * | 12/1999 | Schinnerer | 345/558 |
| 6,317,124 | B2 | 11/2001 | Reynolds | |
| 6,405,267 | B1 * | 6/2002 | Zhao et al. | 710/35 |
| 7,149,909 | B2 | 12/2006 | Cui et al. | |
| 7,659,900 | B2 | 2/2010 | MacInnis et al. | |
| 7,675,522 | B2 | 3/2010 | Kubota et al. | |

(Continued)

FOREIGN PATENT DOCUMENTS

| | | |
|---|---|---|
| JP | 2009-139652 | 6/2009 |
| KR | 1997-0705116 | 9/1997 |

(Continued)

*Primary Examiner* — Ming Hon
*Assistant Examiner* — Shivang Patel
(74) *Attorney, Agent, or Firm* — F. Chau & Associates, LLC

(57) ABSTRACT

A display driver integrated circuit which includes a distributor configured to output display data; a plurality of first-in first-out (FIFO) memories configured to receive the display data from the distributor according to an external clock and output the display data in response to an internal clock; and a plurality of graphics memories configured to receive the display data from the FIFO memories.

23 Claims, 17 Drawing Sheets

(56) References Cited

U.S. PATENT DOCUMENTS

| | | | | |
|---|---|---|---|---|
| 7,916,148 | B2 | 3/2011 | Radke | |
| 8,817,033 | B2 | 8/2014 | Hur et al. | |
| 2002/0057265 | A1 | 5/2002 | Tamura et al. | |
| 2005/0078070 | A1 | 4/2005 | An | |
| 2006/0187226 | A1 | 8/2006 | Bruno et al. | |
| 2008/0225603 | A1* | 9/2008 | Hein | 365/189.05 |
| 2009/0309889 | A1* | 12/2009 | Bae et al. | 345/531 |
| 2010/0260055 | A1* | 10/2010 | Anderson et al. | 370/252 |

FOREIGN PATENT DOCUMENTS

| | | |
|---|---|---|
| KR | 100213474 | 5/1999 |
| KR | 1020020059219 | 7/2002 |
| KR | 100414750 | 12/2003 |
| KR | 1020050089644 | 9/2005 |
| KR | 1020060004857 | 1/2006 |
| KR | 100858479 | 9/2008 |
| KR | 1020090128813 | 12/2009 |

* cited by examiner

DISPLAY DRIVER INTEGRATED CIRCUIT INCLUDING FIRST-IN-FIRST-OUT (FIFO) MEMORIES CONFIGURED TO RECEIVE DISPLAY DATA FROM A DISTRIBUTOR AND OUTPUT THE DISPLAY DATA TO GRAPHICS MEMORIES A DISPLAY SYSTEM HAVING THE SAME, AND A DISPLAY DATA PROCESSING METHOD THEREOF

CROSS-REFERENCE TO RELATED APPLICATION

This application claims priority under 35 U.S.C. §119 to Korean Patent Application No. 10-2012-0105823, filed Sep. 24, 2012, in the Korean Intellectual Property Office, the disclosure of which is incorporated by reference herein in its entirety.

BACKGROUND

1. Technical Field

The inventive concept relates to a display driver integrated circuit, a display system including the same, and a display data processing method thereof.

2. Discussion of the Related Art

With the advent of a smart phone which includes a high-definition television (HDTV) class of super resolution display module, a wide extended graphics array (WXGA) (800×1280) or full HD class (1080×1920) of super resolution mobile display driver integrated circuit (DDI) using organic light emitting display (OLED) and/or low temperature polysilicon liquid crystal display (LTPS-LCD) techniques may be needed. The DDI may necessitate a variety of solutions for low-power driving with a view to reducing current consumption, heat, and burden of an application processor (AP) when the super resolution mobile display is driven.

In addition, the amount of data transferred between the DDI and a CMOS image sensor (CIS) and a mobile AP through a high speed serial interface (HSSI) may increase to cope with a super resolution such as full HD. Accordingly, there may be a need for a DDI with high-speed driving capacity.

SUMMARY

An exemplary embodiment of the inventive concept provides a display driver integrated circuit (DDI) including: a distributor configured to output display data; a plurality of first-in first-out (FIFO) memories configured to receive the display data from the distributor according to an external clock and output the display data in response to an internal clock; and a plurality of graphics memories configured to receive the display data from the FIFO memories.

A frequency of the internal clock is greater than a frequency of the external clock.

The distributor receives the display data at a first frequency.

The display data is output from the distributor at a second frequency, wherein the second frequency is equal to or greater than the first frequency divided by the number of FIFO memories.

The display data is output from the FIFO memories at a third frequency, wherein the third frequency is greater than the second frequency and less than the first frequency.

The display data is output from the FIFO memories at a third frequency, wherein the third frequency is equal to a frequency of the internal clock.

The number of FIFO memories is equal to the number of graphics memories.

The distributor receives the display data via a high speed serial interface.

The distributor receives the display data at a frequency of 125 MHz.

The DDI further includes an oscillator configured to generate the internal clock.

An exemplary embodiment of the inventive concept provides a DDI including: a distributor configured to output display data; a plurality of FIFO memories configured to receive the display data from the distributor and output the display data; and a plurality of graphics memories configured to receive the display data from the FIFO memories in response to an internal clock and output the display data in response to the internal clock.

The display data is received at the graphics memories according to a write enable signal at a rising edge of the internal clock.

The display data is output from the graphics memories according to a scan enable signal at a falling edge of the internal clock.

The DDI further includes a timing controller configured to control the write enable signal and the scan enable signal.

A frequency at which the display data is received at the graphics memories is the same as a frequency at which the display data is output from the graphics memories.

The display data is received by the FIFO memories according to an external clock and the display data is output from the FIFO memories in response to the internal clock.

A frequency of the internal clock is greater than a frequency of the external clock.

The graphics memories do not include arbitration circuits.

The DDI further includes an oscillator configured to generate the internal clock.

Each of the graphics memories has a corresponding FIFO memory.

An exemplary embodiment of the inventive concept provides a DDI including: a distributor configured to output display data; a plurality of FIFO memories configured to receive the display data from the distributor; and a plurality of graphics memories configured to receive the display data from the FIFO memories, wherein FIFO memory pairs each share a data line with a corresponding graphics memory pair.

The FIFO memories receive the display data from the distributor at a first frequency and output the display data via the data lines at a second frequency, wherein the second frequency is greater than the first frequency.

The FIFO memories receive the display data from the distributor according to an external clock and output the display data in response to an internal clock.

The graphics memories receive the display data from the FIFO memories in response to an internal clock.

An exemplary embodiment of the inventive concept provides a data processing method of a DDI that includes: writing display data from a distributor to a plurality of FIFO memories according to an external clock; writing the display data from the FIFO memories to a plurality of graphics memories in response to an internal clock; and scanning the display data of the graphics memories to an image data processing block in response to the internal clock.

BRIEF DESCRIPTION OF THE DRAWINGS

The above and other features of the inventive concept will become more apparent by describing in detail exemplary embodiments thereof with reference to the accompanying drawings.

DETAILED DESCRIPTION OF THE EMBODIMENTS

Figure 1:
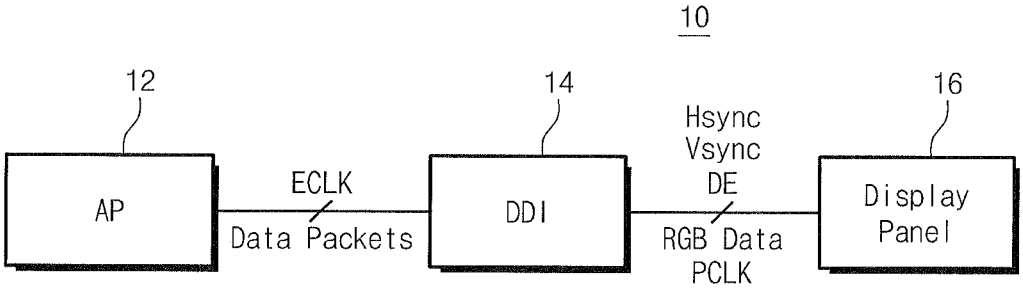
FIG. 1 is a block diagram illustrating a display system according to an exemplary embodiment of the inventive concept.

Hereinafter, exemplary embodiments of the inventive concept will be described in detail with reference to the accompanying drawings. The inventive concept may, however, be embodied in various different forms and should not be construed as being limited to the embodiments set forth herein. Throughout the drawings and specification, like reference numerals may refer to like elements.

FIG. 1 is a block diagram illustrating a display system according to an exemplary embodiment of the inventive concept. Referring to FIG. 1, a display system 10 may include an application processor (which hereinafter, may be referred to as "AP") 12, a display driver integrated circuit (which hereinafter, may be referred to as "DDI") 14, and a display panel 16.

The AP 12 may control an overall operation of the display system 10. The AP 12 may input and output data packets each having display data in response to a clock ECLK. Herein, a data packet may include display data, a horizontal synchronization signal Hsync, a vertical synchronization signal Vsync, a data enable signal DE, and so on.

The DDI 14 may receive data packets from the AP 12 through a mobile interface, and may output the horizontal synchronization signal Hsync, the vertical synchronization signal Vsync, the data enable signal DE, display data RGB Data, a clock PCLK. Herein, the mobile interface may be a high speed serial interface such as a mobile industry processor interface (MIPI), a mobile display digital interface (MDDI), a compact display port (CDP), a mobile pixel link (MPL), a current mode advanced differential signaling (CMADS), or the like. In the following exemplary embodiments, it is assumed that the DDI 14 interfaces according to the MIPI.

The DDI 14 may include a graphic memory (e.g., graphic random access memory (GRAM)) for the high speed serial interface. Herein, the GRAM may be used to reduce current consumption, heat, and burden of the AP 12. The GRAM may be configured to write display data input from the AP 12 and to output written data through a scan operation. In an exemplary embodiment, the GRAM may be a dual-port dynamic random access memory (DRAM).

The DDI 14 may be configured to not include the graphic memory for the high speed serial interface. In this case, the DDI 14 may buffer data packets to output display data. In the following exemplary embodiments, it is assumed that the DDI 14 uses the GRAM.

The display panel 16 may display data (e.g., display data) by frame under control of the DDI 14. The display panel 16 may be an organic light emitting display (OLED) panel, a liquid crystal display (LCD) panel, a plasma display panel (PDP), an electrophoretic display panel, or an electrowetting display panel. However, the display panel 16 is not limited thereto.

The display system 10 may be used for a high speed interface by including the DDI 14 using the GRAM.

Figure 2:
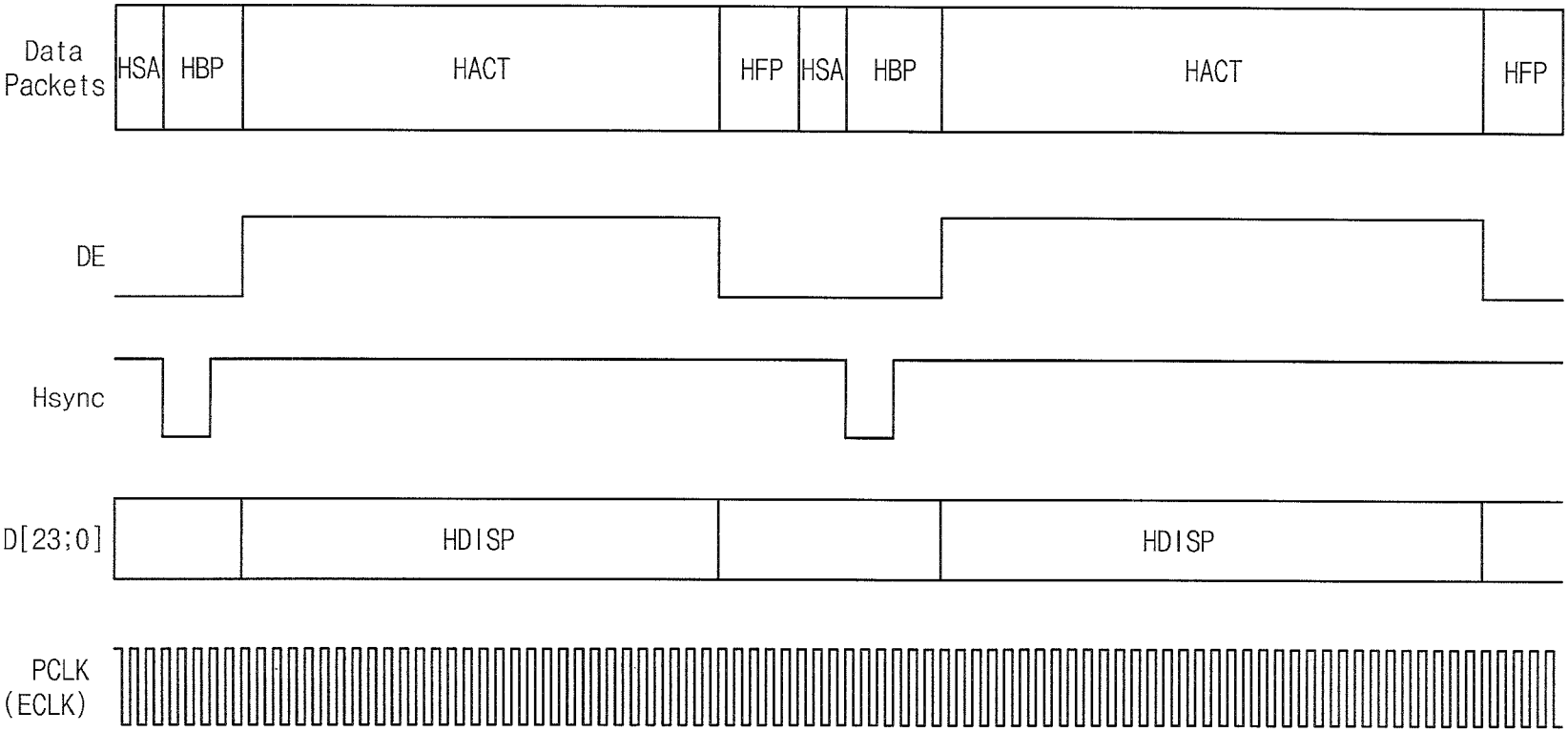
FIG. 2 is a diagram illustrating a data packet according to an exemplary embodiment of the inventive concept.

FIG. 2 is a diagram illustrating a data packet according to an exemplary embodiment of the inventive concept. In FIG. 2, a data packet may be data which is displayed on the display panel 16 in a horizontal direction. A data packet may include a horizontal speed action (HSA) packet, a horizontal back porch (HBP) packet, a horizontal active (HACT) packet, and a horizontal front porch (HFP) packet. However, a data packet of the inventive concept is not limited thereto.

The DDI 14 (refer to FIG. 1) may receive a data packet to be displayed in a horizontal direction to output a data enable signal DE, a horizontal synchronization signal Hsync, RGB data D[23:0], and a clock PCLK. Herein, the clock PCLK may be the clock ECLK (refer to FIG. 1) provided from the AP 12 (refer to FIG. 1).

In FIG. 2, there is illustrated a data packet to be displayed in a horizontal direction. However, a data packet to be displayed in a vertical direction may be the same or substantially the same as a data packet to be displayed in a horizontal direction.

Figure 3:
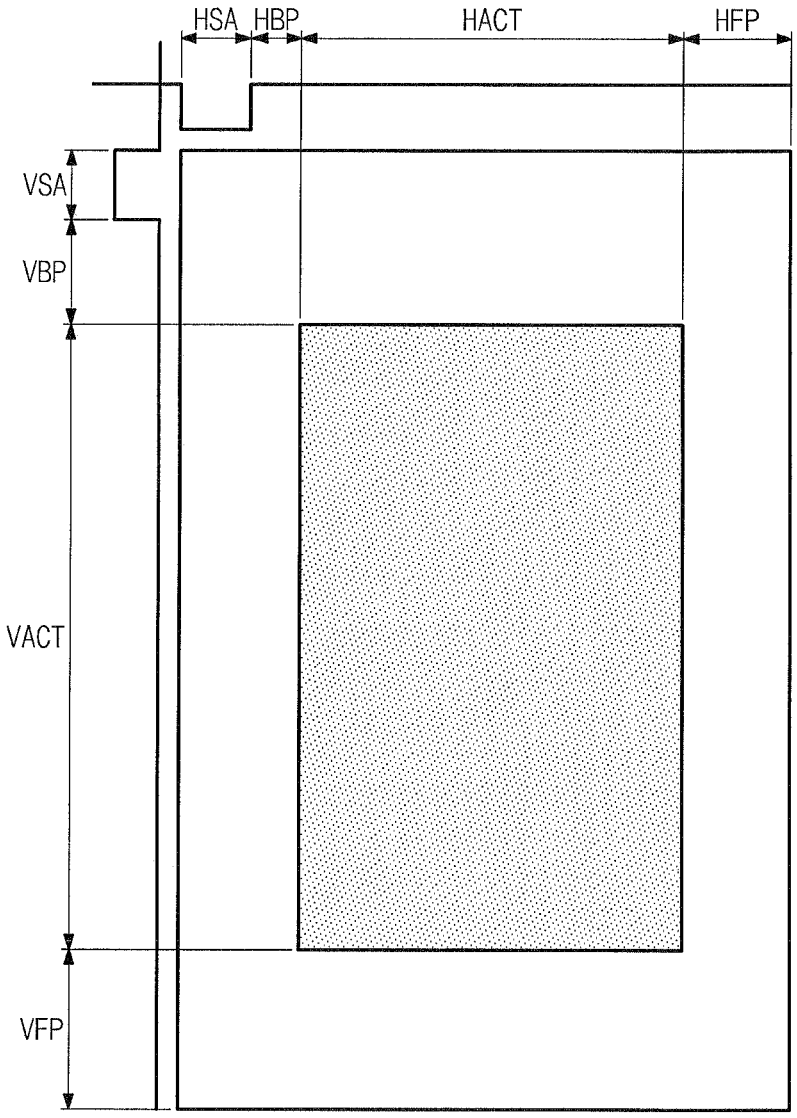
FIG. 3 is a display timing diagram according to an exemplary embodiment of the inventive concept.

FIG. 3 is a display timing diagram according to an exemplary embodiment of the inventive concept. Referring to FIG. 3, a frame displayed at FIG. 2 may be illustrated.

A frame may include a horizontal speed action (HSA), a horizontal back porch (HBP), a horizontal active (HACT), and a horizontal front porch (HFP) on the basis of a horizontal synchronization signal Hsync in a horizontal direction.

A frame may include a vertical speed action (VSA), a vertical back porch (VBP), a vertical active (VACT), and a vertical front porch (VFP) on the basis of a vertical synchronization signal Vsync in a vertical direction.

The display timing values of the above-described frames may be various according to a resolution of the display panel 16 (refer to FIG. 1).

For ease of description, it is assumed that data packets are transferred between the AP 12 and the DDI 14 (refer to FIG. 1) according to the MIPI.

Figure 4A:
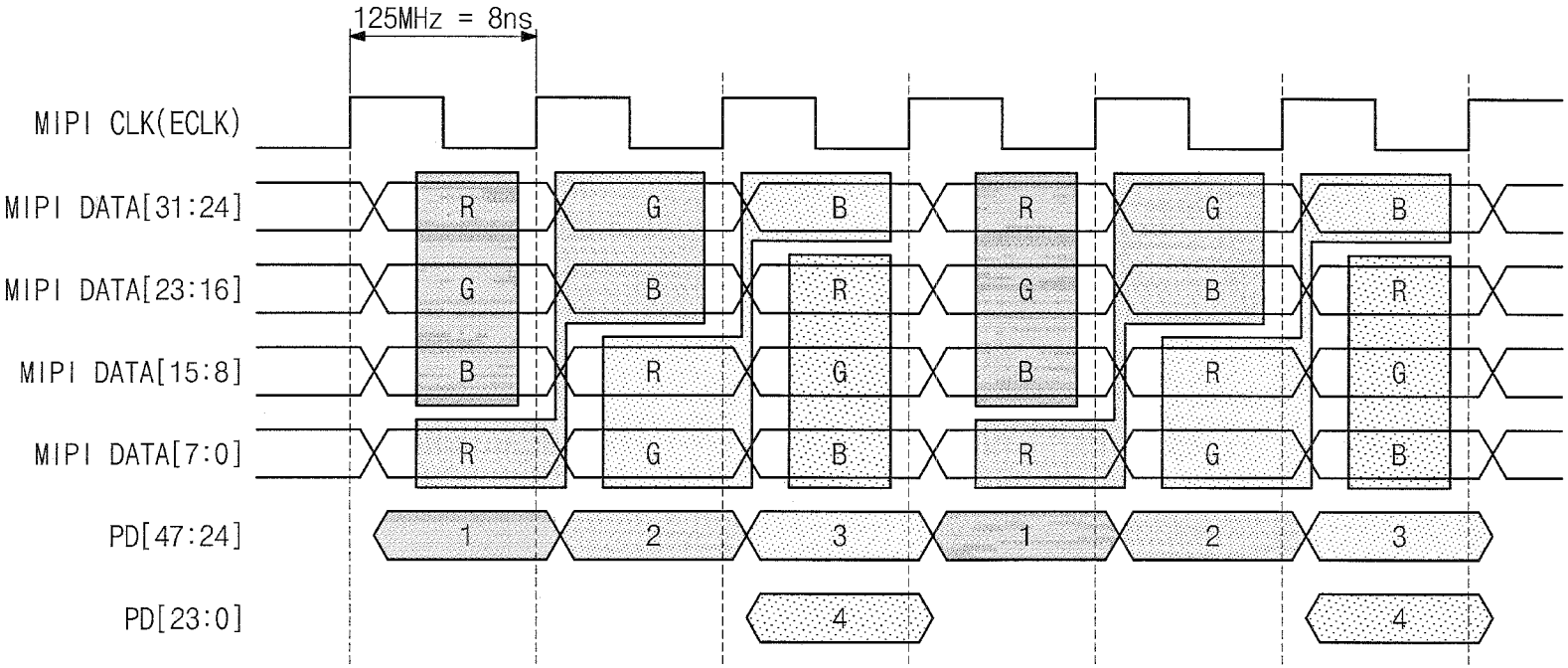
FIG. 4A is a diagram illustrating an input of mobile industry processor interface (MIPI) data according to an exemplary embodiment of the inventive concept.

FIG. 4A is a diagram illustrating an input of MIPI data according to an exemplary embodiment of the inventive concept. Referring to FIG. 4A, there is illustrated an example in which display data is input according to the 4-lane MIPI. With the 4-lane MIPI, data packets MIPI DATA[7:0], MIPI DATA [15:8], MIPI DATA[23:16], and MIPI DATA[31:24] may be transferred to the DDI 14 from the AP 12 (refer to FIG. 1) at a frequency of 1 Gbps. In other words, if 1 Gbps is converted by the byte on the basis of the MIPI 4-lane, display data may be received using an external clock MIPI CLK of 125 MHz. 32-bit display data may be input every one byte clock, in other words, every 125 MHz (=8 ns). In addition, four pixel data may be received every three clocks MIPI CLK (e.g., ECLK in FIG. 1). Herein, pixel data may be formed of one byte of red data, one byte of green data, and one byte of blue data.

For example, in FIG. 4A, pixel data 1 of PD[47:24] includes dark-shaded R,G,B in the first period of MIPI CLK, pixel data 2 of PD[47:24] includes lighter-shaded R,G,B in the first and second periods of MIPI CLK, pixel data 3 of PD[47:24] includes even lighter-shaded R,G,B in the second and third periods of MIPI CLK and pixel data 4 of PD[23:0] includes least-shaded R,G,B in the third period of MIPI CLK.

The data packets of MIPI data according to an exemplary embodiment of the inventive concept are not limited to be input according to the 4-lane MIPI. The data packets of MIPI data according to an exemplary embodiment of the inventive concept may be input according to at least one lane MIPI.

Figure 4B:
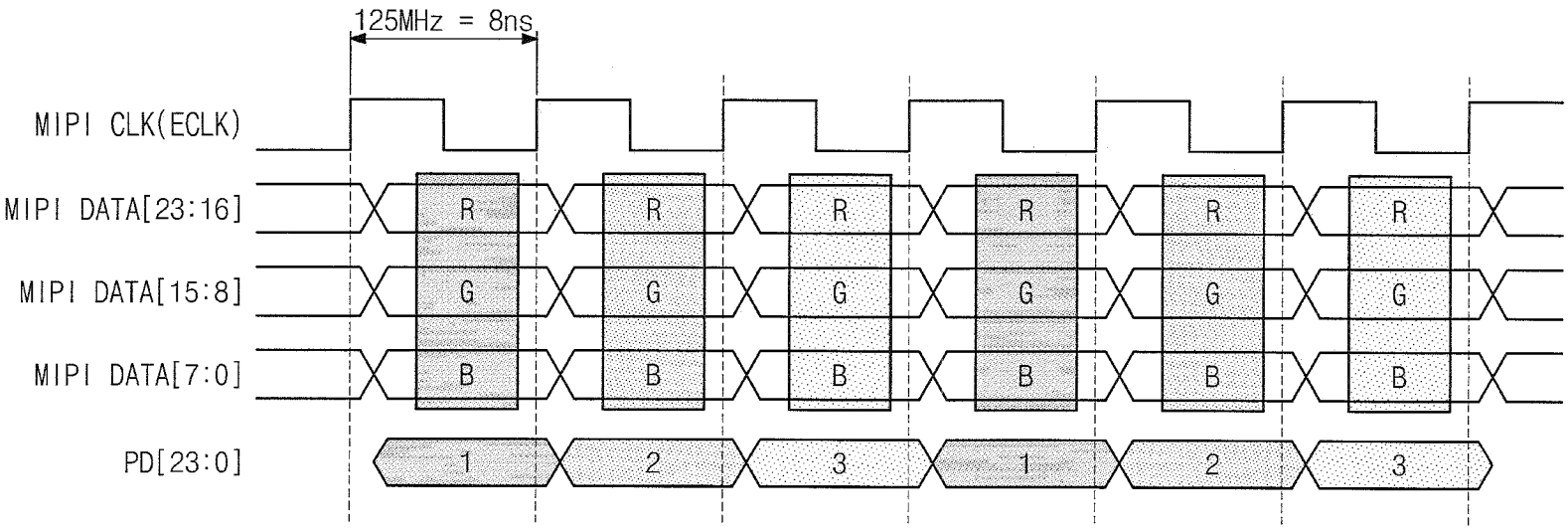
FIG. 4B is a diagram illustrating an input of MIPI data according to an exemplary embodiment of the inventive concept.

FIG. 4B is a diagram illustrating an input of MIPI data according to an exemplary embodiment of the inventive concept. Referring to FIG. 4B, there is illustrated an example in which display data is input according to the 3-lane MIPI.

In FIG. 4B, 24-bit display data may be input every one byte clock, in other words, every 125 MHz (=8 ns). In addition, three pixel data may be received every three clocks MIPI CLK (e.g., ECLK in FIG. 1). For example, in FIG. 4B, pixel data 1 of PD[23:0] includes R,G,B in the first period of MIPI CLK, pixel data 2 of PD[23:0] includes R,G,B in the second period of MIPI CLK and pixel data 3 of PD[23:0] includes R,G,B in the third period of MIPI CLK.

Figure 5:
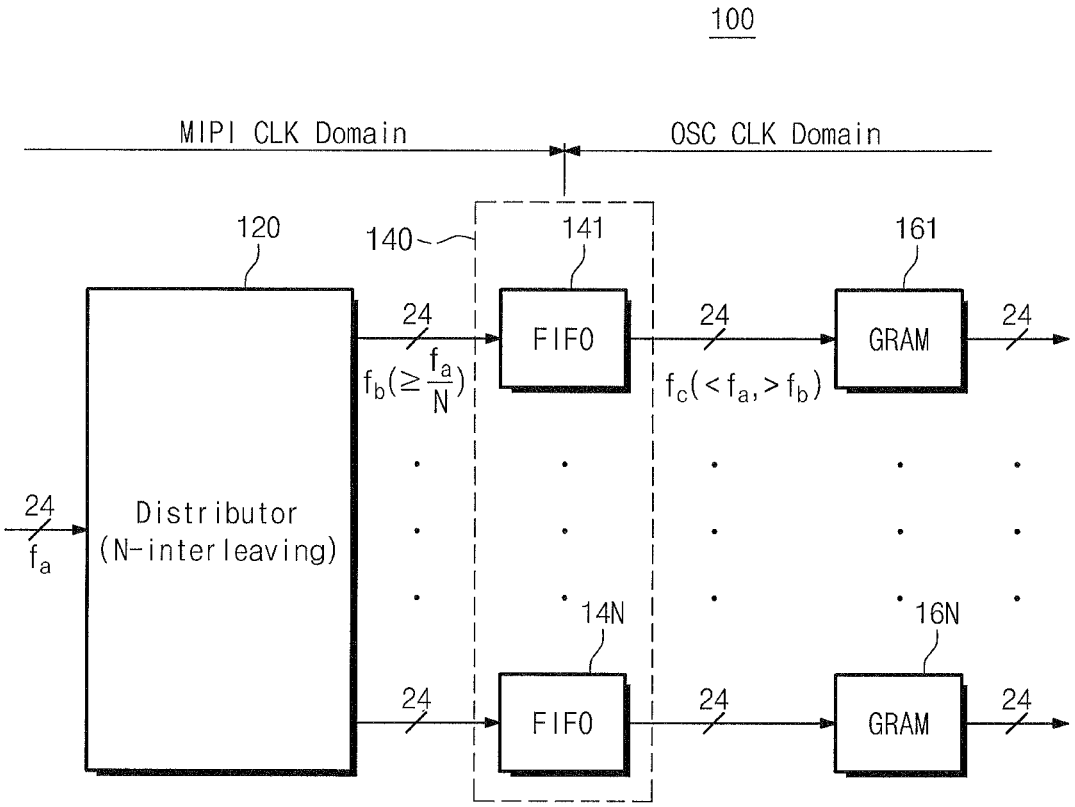
FIG. 5 is a diagram illustrating a data driver integrated circuit (DDI) according to an exemplary embodiment of the inventive concept.

FIG. 5 is a diagram illustrating a DDI according to an exemplary embodiment of the inventive concept. A DDI 100 according to an exemplary embodiment of the inventive concept may include a distributor 120, a plurality of first-in first-out (FIFO) memories 141 to 14N (N being an integer more than 2), and a plurality of graphic memories 161 to 16N.

The distributor 120 may receive 24-bit display data (or, pixel data) in response to an external clock MIPI CLK to interleave the input display data into N (which hereinafter, may be referred to as "N interleaving"). Herein, the N interleaving may be a technique in which adjacent display data is stored at N different physical areas to be accessed from many places. An interleaving technique is disclosed in U.S. Patent Application Publication No. 2011/0157200, the disclosure of which is incorporated by reference herein in its entirety.

The distributor 120 may not be limited to receive 24-bit display data. The distributor 120 may be configured to receive M-bit display data (M being an integer more than 2). In an exemplary embodiment, the distributor 120 may be implemented by a cache memory or a direct memory access (DMA).

The distributor 120 may receive display data using a first frequency fa, and may output display data interleaved using a second frequency fb. Herein, the first frequency fa may be a frequency of the external clock MIPI CLK, and the second frequency fb may be equal to or higher than a frequency fa/N obtained by dividing the first frequency fa by N.

Each of the FIFO memories 141 to 14N may store interleaved 24-bit display data according to the external clock MIPI CLK. Each of the FIFO memories 141 to 14N may output 24-bit display data (or, pixel data) in response to an internal clock OSC CLK. Herein, a frequency of the internal clock OSC CLK may be lower than a frequency of the external clock MIPI CLK. Thus, each of the FIFO memories 141 to 14N may be used as an asynchronous FIFO memory.

Each of the FIFO memories 141 to 14N may store display data interleaved using the second frequency fb, and may output the stored display data using a third frequency fc. Herein, the third frequency fc may be lower than the first frequency fa and higher than the second frequency fb. In other words, a speed in which display data is read from the FIFO memories 141 to 14N may be rapider than a speed in which display data is written to the FIFO memories 141 to 14N. This may satisfy a condition that stored display data is drawn out from the FIFO memories 141 to 14N before the FIFO memories 141 to 14N are filled by display data.

In an exemplary embodiment, each of the FIFO memories 141 to 14N may be implemented by a flip-flop, a static random access memory (SRAM), or a dual-port SRAM.

The graphic memories 161 to 16N may store 24-bit display data respectively output from the FIFO memories 141 to 14N in response to the internal clock OSC CLK. Each of the graphic memories 161 to 16N may scan stored 24-bit display data in response to the internal clock OSC CLK.

In an exemplary embodiment, each of the graphic memories 161 to 16N may be implemented by a DRAM or a dual-port DRAM.

As described above, each of the graphic memories 161 to 16N may perform a write operation and a scan operation in response to the internal clock OSC CLK. A clock domain of the graphic memories 161 to 16N may be united by the internal clock OSC CLK.

Each of the graphic memories 161 to 16N may be configured to enable an access of a write operation or an access of a scan operation through one-dimensional/two-dimensional address arrangement.

Figure 6:
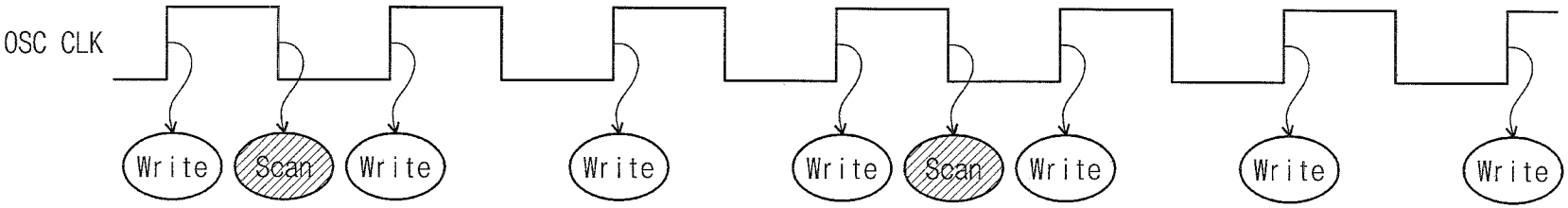
FIG. 6 is a diagram illustrating timing of write and scan operations of each of graphic memories in FIG. 5, according to an exemplary embodiment of the inventive concept.

FIG. 6 is a diagram illustrating timing of write and scan operations of each of graphic memories in FIG. 5, according to an exemplary embodiment of the inventive concept. Referring to FIG. 6, a write operation and a scan operation may be performed in response to an internal clock OSC CLK. For example, the write operation may be performed in response to a rising edge of the internal clock OSC CLK, and the scan operation may be performed in response to a falling edge of the internal clock OSC CLK. As illustrated in FIG. 6, the scan operation may be performed once after the write operation is performed three times.

In the case of a general graphic memory, an arbitration circuit may be used to perform write and scan operations at a specific address or a normal write/scan/read operation when scan and read commands are input at the same time. Since a write clock and a scan clock of the arbitration circuit are limited, a maximum frequency of a general graphic memory may be limited by the arbitration circuit. Since each general graphic memory includes its own arbitration circuit, a size of the general graphic memory may increase. Further, to drive a wide extended graphics array (WXGA) class of super resolution display, 4M-bit or larger display data per frame may be provided to a DDI (e.g., 1 Gbps/lane). However, a general graphic memory may not process 4M-bit or larger display data per frame using its maximum operating frequency.

On the other hand, as illustrated in FIG. 6, the DDI 100 (refer to FIG. 5) according to an exemplary embodiment of the inventive concept may remove a read operation for display data. For example, the DDI 100 according to an exemplary embodiment of the inventive concept may transfer data converted through a scan operation instead of a read operation in response to a read request of an external host. The DDI 100 according to an exemplary embodiment of the inventive concept may also remove an arbitration circuit which limits a maximum operating frequency and affects a size of a graphic memory.

As illustrated in FIG. 5, the DDI 100 according to an exemplary embodiment of the inventive concept may be configured to drive graphic memories 161 to 16N using a unified internal clock OSC CLK which is used as a write clock and a scan clock. As a result, the graphic memories 161 to 16N may process high speed display data input for driving of a super resolution display using a maximum operating frequency.

Figure 7:
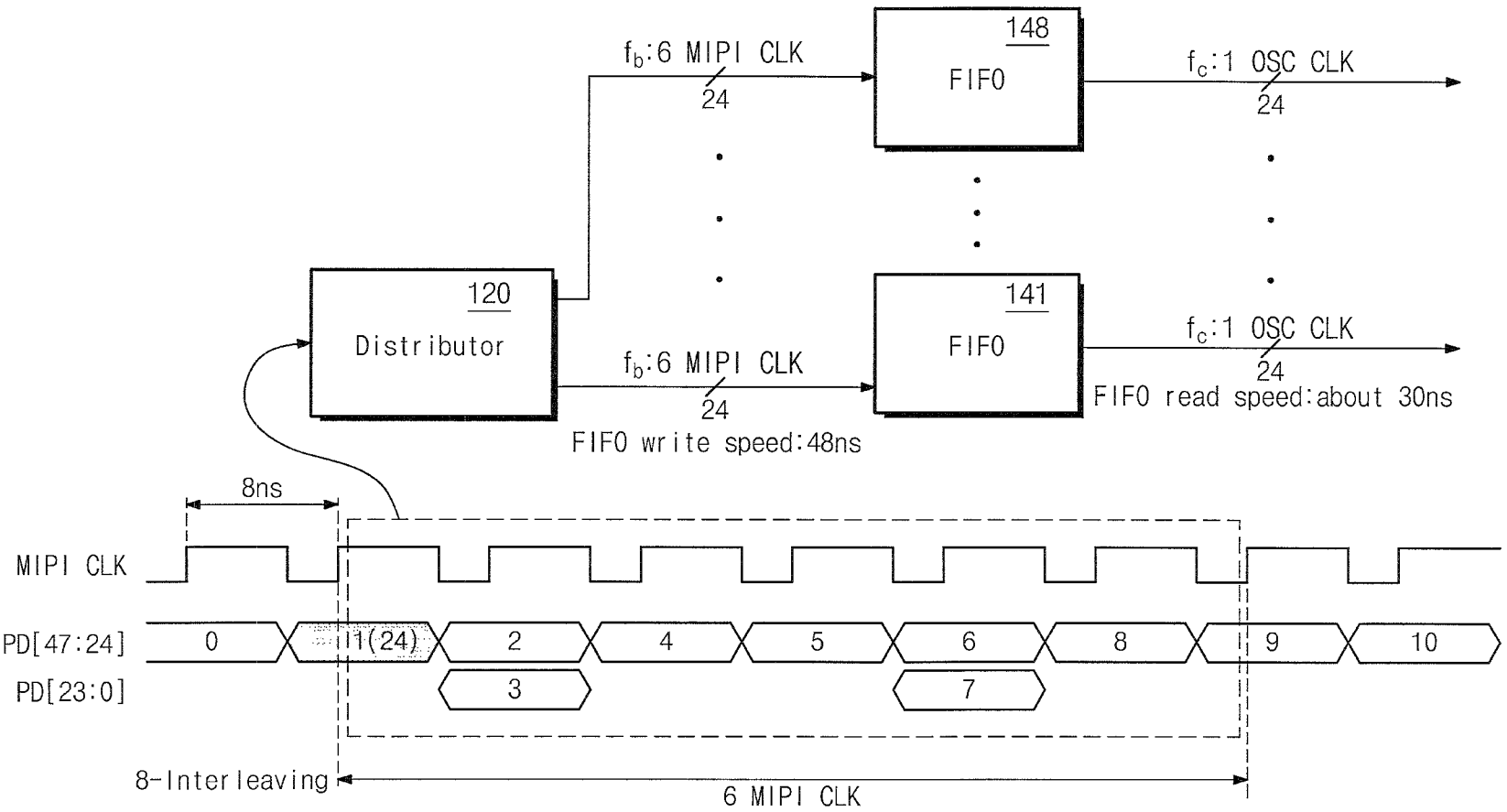
FIG. 7 is a diagram illustrating data timing when interleaving according to an exemplary embodiment of the inventive concept is performed.

FIG. 7 is a diagram illustrating data timing when interleaving according to an exemplary embodiment of the inventive concept is performed. Referring to FIG. 7, there is illustrated timing of input data according to the 4-lane MIPI (e.g., 1 Gbps at 125 MHz) which is a high speed serial interface standard in a WXGA class of super resolution display (corresponding to a full high definition (HD) display class). An 8-interleaving technique may be applied to satisfy a frequency condition of input data. In other words, as illustrated in FIG. 7, eight pixel data (e.g., pixel data 1-8 of PD[47:24] and PD[23:0] may be provided to a distributor 120 during six cycles of an external clock MIPI CLK. Herein, one pixel data may be formed of 24-bit data.

The distributor 120 may interleave eight pixel data during six cycles of the external clock MIPI CLK to be stored at eight FIFO memories 141 to 148, respectively. Each of the FIFO memories 141 to 148 may output stored pixel data during one cycle of an internal clock OSC CLK. In other words, a write speed fb of each of the FIFO memories 141 to 148 may be about 48 ns. A read speed fc of each of the FIFO memories 141 to 148 may be faster than the write speed fb. For example, a read speed fc of each of the FIFO memories 141 to 148 may be about 30 ns. Herein, the read speed fc of each of the FIFO memories 141 to 148 may be a write speed of each of graphic memories 161 to 16N (refer to FIG. 5).

The DDI 100 (refer to FIG. 5) according to an exemplary embodiment of the inventive concept may use the FIFO memories 141 to 148 to eliminate an arbitration circuit used by a conventional graphic memory. In an exemplary embodiment of the inventive concept, each of the graphic memories 161 to 16N may store pixel data using an internal clock OSC CLK generated from an oscillator of the DDI 100 without using an external clock MIPI CLK. In other words, each of the graphic memories 161 to 16N may operate responsive to the internal clock OSC CLK instead of clocks for input/output operations (e.g., write and scan operations).

Figure 8A:
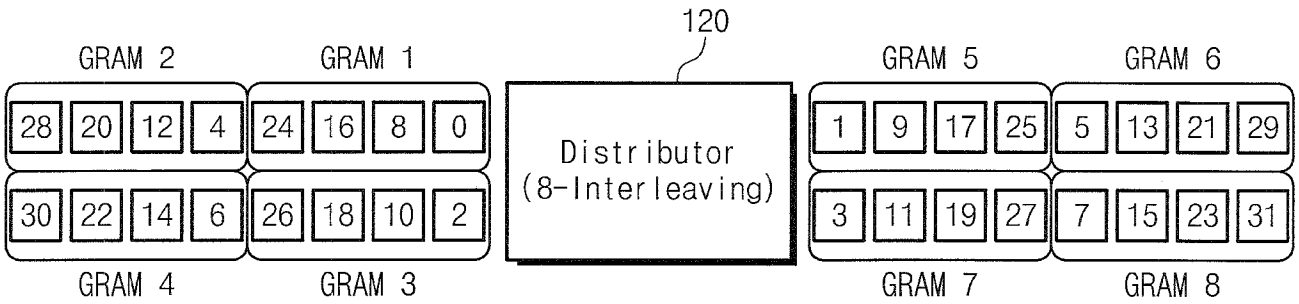
FIG. 8A is a diagram illustrating an interleaving of a distributor according to an exemplary embodiment of the inventive concept.

FIG. 8A is a diagram illustrating an interleaving of a distributor according to an exemplary embodiment of the inventive concept. Referring to FIG. 8A, a distributor 120 may perform 8-interleaving. For the 8-interleaving, 32 memory blocks may be used. The 32 memory blocks 0 to 31 may be divided into eight groups GRAM1 to GRAM8, each of which includes four memory blocks. Herein, the 32 memory blocks may be implemented by at least one or more graphic memories.

The distributor 120 may perform the 8-interleaving by performing an access operation (e.g., a write operation) sequentially from a 0th memory block to a 31st memory block.

The distributor 120 according to an exemplary embodiment of the inventive concept is not limited to performing the 8-interleaving. The distributor 120 according to an exemplary embodiment of the inventive concept may perform N-interleaving in which a plurality of memory blocks is divided into N groups and the N groups are sequentially accessed.

Figure 8B:
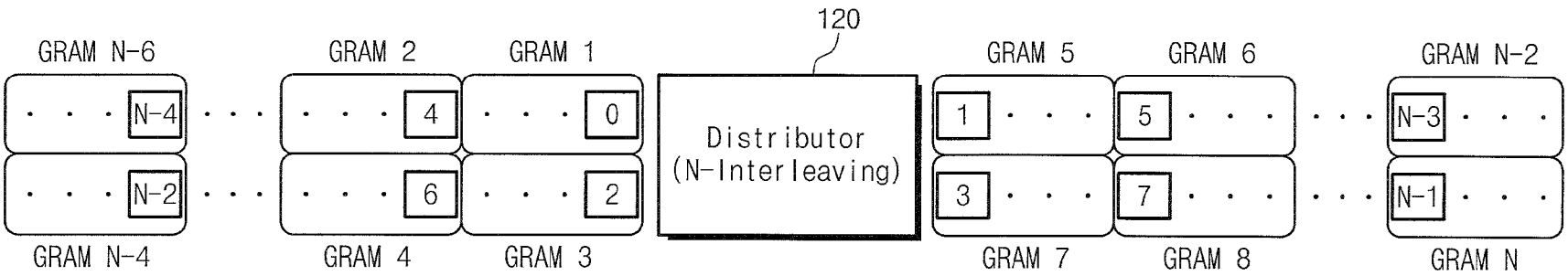
FIG. 8B is a diagram illustrating an interleaving of a distributor according to an exemplary embodiment of the inventive concept.

FIG. 8B is a diagram illustrating an interleaving of a distributor according to an exemplary embodiment of the inventive concept. Referring to FIG. 8B, each of a plurality of graphic memories GRAM1 to GRAMN may include a plurality of memory blocks 0 to N−1, and a distributor 120 may access memory blocks according to a given order once per N times.

Figure 9A:
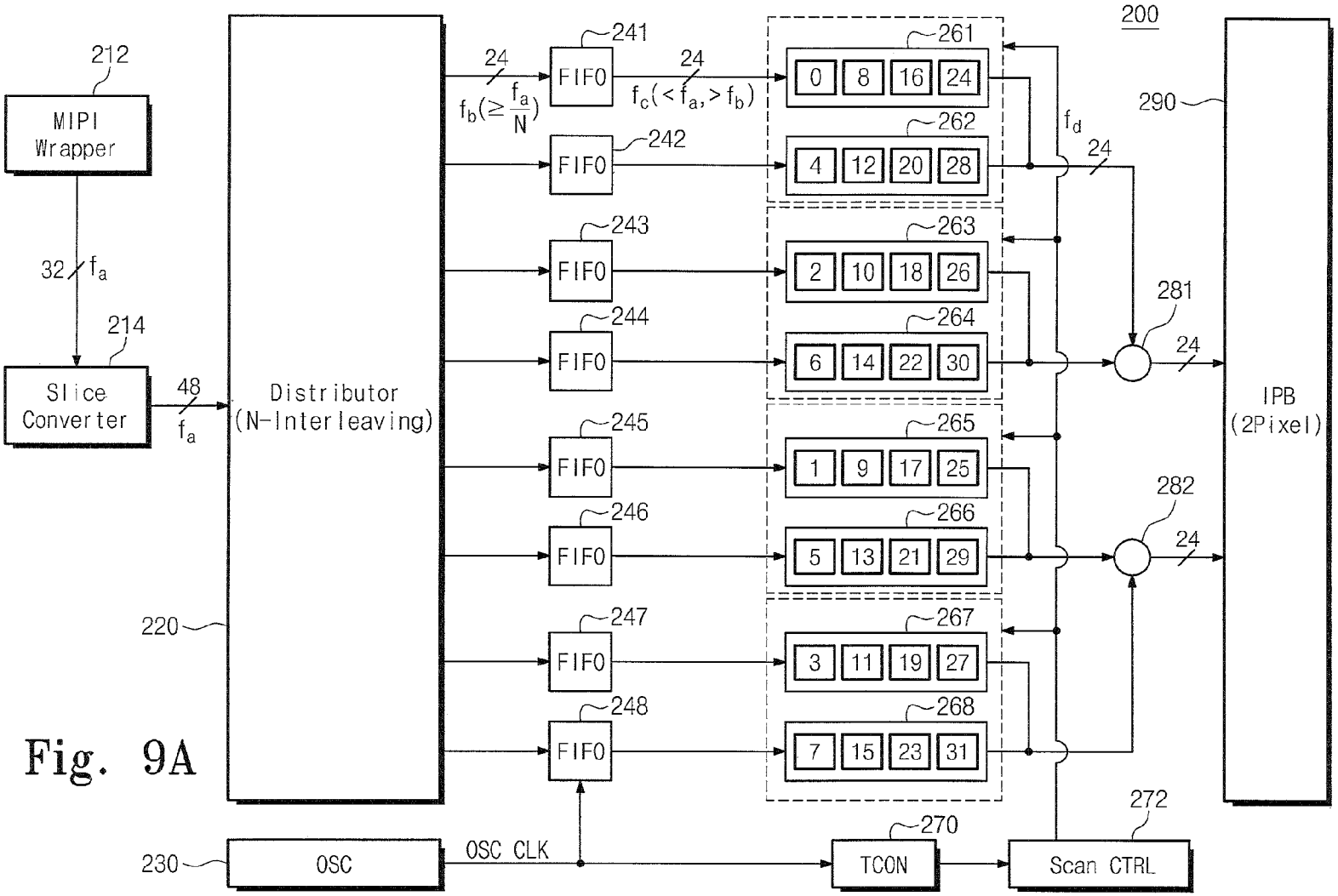
FIG. 9A is a block diagram illustrating a DDI according to an exemplary embodiment of the inventive concept.

FIG. 9A is a block diagram illustrating a DDI according to an exemplary embodiment of the inventive concept. Referring to FIG. 9A, a DDI 200 may include a MIPI wrapper 212, a slice converter 214, a distributor 220, an oscillator 230, FIFO memories 241 to 248, graphic memories 261 to 268, a timing controller 270, a scan controller 272, first and second data mergers 281 and 282, and an image data processing block 290.

The MIPI wrapper 212 may receive display data according to a high speed serial interface, and may output 32-bit display data in response to an external clock MIPI CLK. Herein, a frequency fa of the external clock MIPI CLK may be about 125 MHz.

The slice converter 214 may receive display data output from the MIPI wrapper 212, and may convert the input display data into 48-bit display data (e.g., 2-pixel data) in response to the external clock MIPI CLK.

The distributor 220 may receive the 48-bit display data from the slice converter 214 to perform an N-interleaving. For ease of description, it is assumed that the distributor 220 performs an 8-interleaving.

The oscillator 230 may generate an internal clock OSC CLK.

Each of the FIFO memories 241 to 248 may perform a write operation using a frequency fb (≥fa/8) (e.g., 20.8 MHz) to store 24-bit display data interleaved by the distributor 220. Each of the FIFO memories 241 to 248 may perform a read operation using a frequency higher than 20.8 MHz to output stored data. At a write operation, the graphic memories 261 to 268 may store 24-bit display data respectively output from the FIFO memories 241 to 248 in response to the internal clock OSC CLK. Herein, a frequency fc of the internal clock OSC CLK may be higher than 20.9 MHz. In other words, a write speed of each of the graphic memories 261 to 268 may be over 20.9 MHz.

Each of the graphic memories 261 to 268 may include a plurality of memory blocks. The graphic memories 261 to 268 may share signals such as a data signal, a command signal, an address signal, and so on. For example, a first graphic memory 261 may include four memory blocks 0, 8, 16, and 24, and the four memory blocks 0, 8, 16, and 24 may share signals.

At a scan operation, each of the graphic memories 261 to 268 may output 24-bit display data in response to the internal clock OSC CLK. The timing controller 270 may generate signals for controlling a write operation or a scan operation of each of the graphic memories 261 to 268. The timing controller 270 may be input with the internal clock OSC CLK.

In an exemplary embodiment, a frequency fd for a scan operation of each of the graphic memories 261 to 268 may be determined such that image fading is not generated in connection with the frequency fc for a write operation.

The scan controller 272 may control scan operations of the graphic memories 261 to 268 in response to control signals from the timing controller 270.

Each of the first and second data mergers 281 and 282 may merge 24-bit display data respectively output from two graphic memories of the graphic memories 261 to 268 to form 2-pixel data. The image data processing block 290 may store 2-pixel data output from the first and second data mergers 281 and 282. The image data processing block 290 may be a contents-based automatic brightness controller or a shift latch of a source driver block. The 2-pixel data stored may be used for display.

The DDI 200 according to an exemplary embodiment of the inventive concept may perform 8-interleaving on display data to store the interleaved display data at the graphic memories 261 to 268 through the FIFO memories 241 to 248.

In addition, a DDI according to an exemplary embodiment of the inventive concept may be configured to include a line sharing between FIFO memories and graphics memories.

Figure 9B:
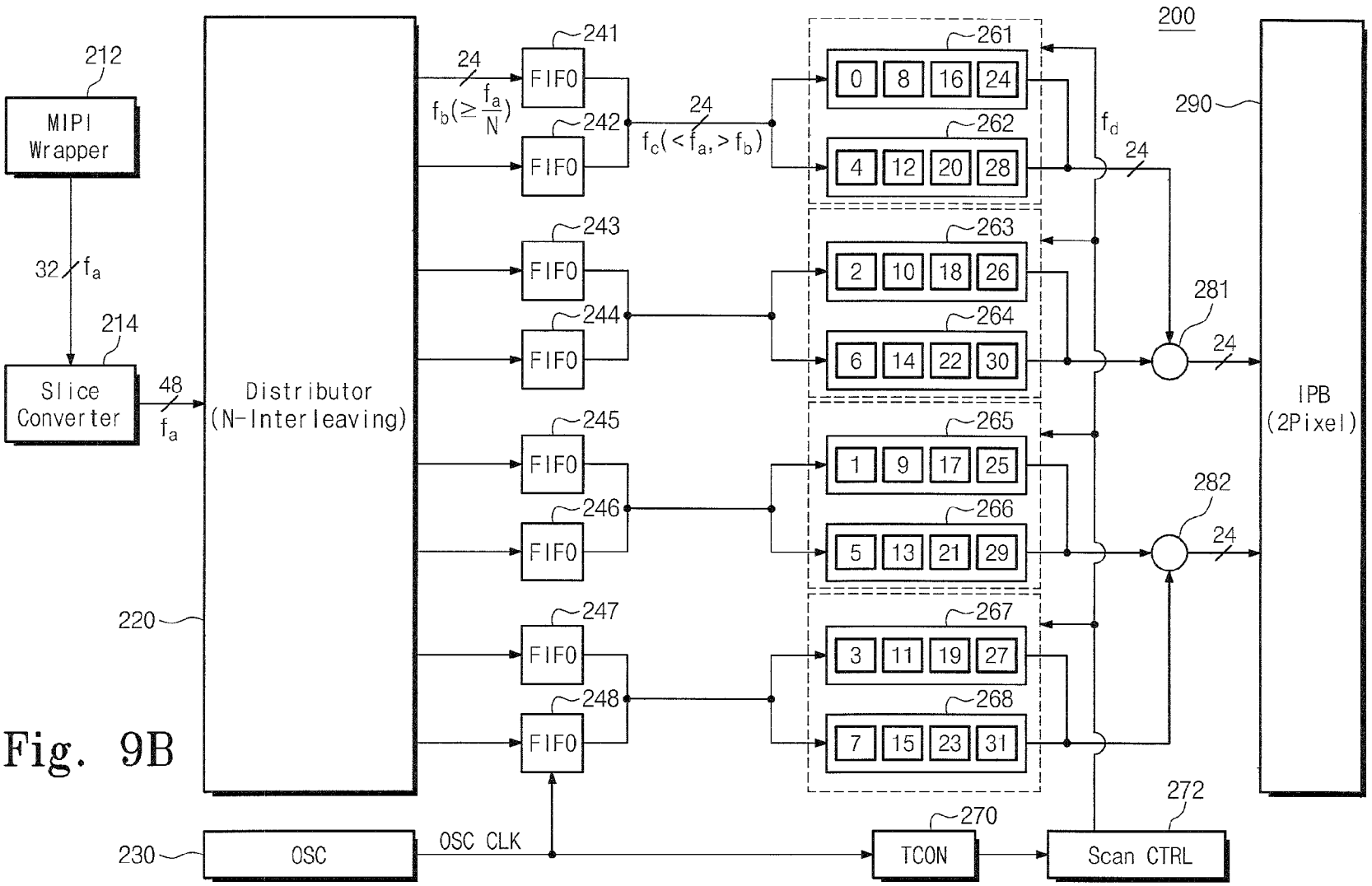
FIG. 9B is a block diagram illustrating a DDI according to an exemplary embodiment of the inventive concept.

FIG. 9B is a block diagram illustrating a DDI according to an exemplary embodiment of the inventive concept. FIG. 9B is similar to FIG. 9A expect that FIFO memory pairs (e.g., 241, 242) each share a data line with a corresponding graphics memory pair (e.g., 261, 262).

In FIGS. 9A and 9B, there is shown and described an example in which the image data processing block 290 processes display data as 2-pixel data. However, an exemplary embodiment of the inventive concept is not limited thereto. The image data processing block 290 may process display data as 4-pixel data.

Figure 10:
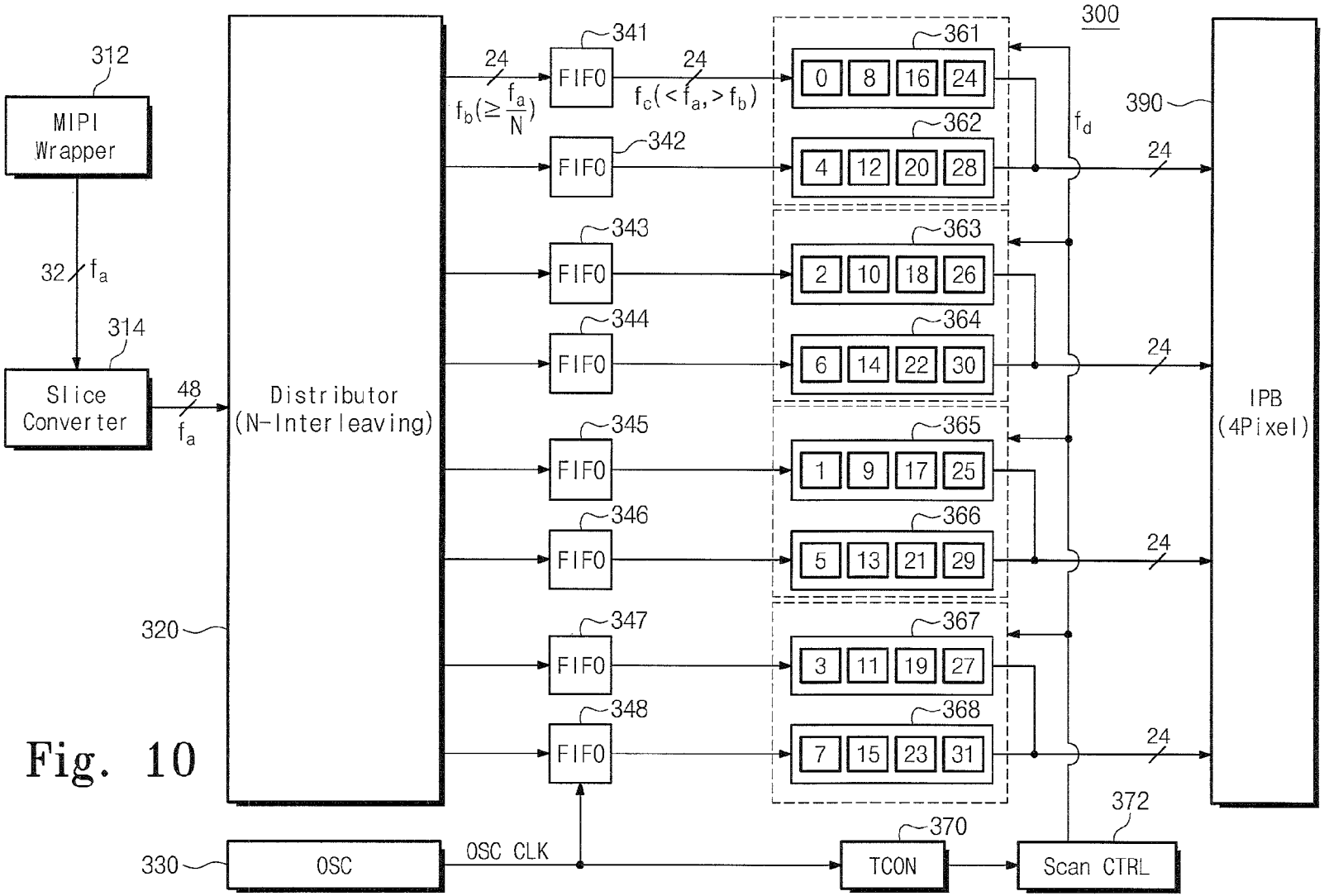
FIG. 10 is a block diagram illustrating a DDI according to an exemplary embodiment of the inventive concept.

FIG. 10 is a block diagram illustrating a DDI according to an exemplary embodiment of the inventive concept. Referring to FIG. 10, a DDI 300 may include a MIPI wrapper 312, a slice converter 314, a distributor 320, an oscillator 330, FIFO memories 341 to 348, graphic memories 361 to 368, a timing controller 370, a scan controller 372, and an image data processing block 390. The DDI 300 in FIG. 10 may be configured the same or substantially the same as the DDI 200 in FIG. 9A or 9B except that the first and second data mergers 281 and 282 in FIG. 9A or 9B are removed and the image data processing block 390 processes display data as 4-pixel data. Thus, a further description of the DDI 300 is omitted.

Figure 11:
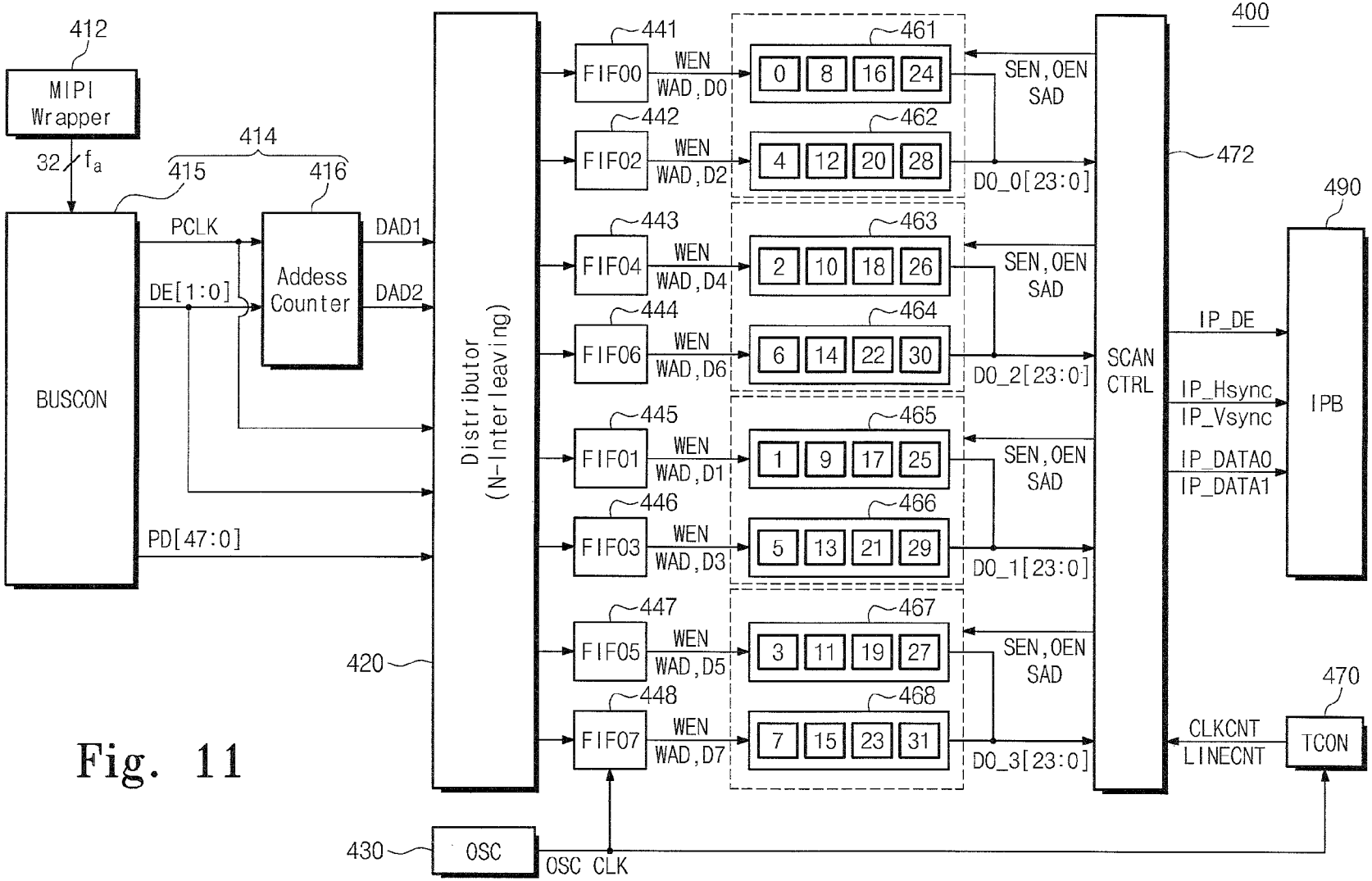
FIG. 11 is a block diagram illustrating a mobile DDI according to an exemplary embodiment of the inventive concept.

FIG. 11 is a block diagram illustrating a mobile DDI according to an exemplary embodiment of the inventive concept. Referring to FIG. 11, a mobile DDI 400 may include a MIPI wrapper 412, a bus controller 415, an address counter 416, a distributor 420, an oscillator 430, FIFO memories 441 to 448, graphic memories 461 to 468, a timing controller 470, a scan controller 472, and an image data processing block 490. In the mobile DDI 400, the slice converter 314 in FIG. 9A or 9B may be implemented by the bus controller 415 and the address counter 416 (e.g., 414).

The bus controller 415 may receive display data from the MIPI wrapper 412, and may output pixel data PD[47:0] in response to a data enable signal DE[1:0] and a clock PCLK. Herein, the clock PCLK may be an external clock MIPI CLK.

The address counter 416 may receive the clock PCLK and the data enable signal DE[1:0] to output addresses DAD1 and DAD2.

The distributor 420 may receive the addresses DAD1 and DAD2 from the address counter 416 and the clock PCLK, the data enable signal DE[1:0], and the pixel data PD[47:0] from the bus controller 415, and may store the pixel data PD[47:0] in the FIFO memories 441 to 448 corresponding to the addresses DAD1 and DAD2 in real time. In other words, the distributor 420 may perform 8-interleaving on the pixel data PD [47:0] (e.g., 2-pixel data) to store the interleaved pixel data PD[47:0] in the FIFO memories 441 to 448.

Each of the FIFO memories 441 to 448 may output an address WAD and 1-byte data D0 to D7 in response to a write enable signal WEN. Herein, the write enable signal WEN may use a rising edge of an internal clock OSC CLK as described in FIG. 6. The address WAD may be a value indicative of a memory block of a corresponding GRAM.

Each of the graphic memories 461 to 468 may perform a scan operation on a memory block corresponding to an address SAD in response to a scan enable signal SEN, and may output scanned data DO_1[23:0] to DO_4[23:0] in response to an output enable signal OEN. Herein, the scan enable signal SEN may use a falling edge of the internal clock OSC CLK as illustrated in FIG. 6.

The timing controller 470 may generate a clock counter signal CLKCNT and a line counter signal LINECNT.

The scan controller 472 may generate the scan enable signal SEN, the address SAD, and the output enable signal OEN in response to the clock counter signal CLKCNT and the line counter signal LINECNT.

The scan controller 472 may output an image data processing enable signal IP_DE, a horizontal synchronization signal IP_Hsync, a vertical synchronization signal IP_Vsync, and first and second display data IP_DATA0 and IP_DATA1. Herein, the first and second display data IP_DATA0 and IP_DATA1 may be data scanned from the graphic memories 461 to 468.

The image data processing block 490 may process the first and second display data IP_DATA0 and IP_DATA1 as 2-pixel data in response to the image data processing enable signal IP_DE.

The mobile DDI 400 according to an exemplary embodiment of the inventive concept may process data in high speed through the graphic memories 461 to 468 which are configured to perform a write operation by an 8-interleaving technique and a scan operation by a 4-interleaving technique.

Figure 12:
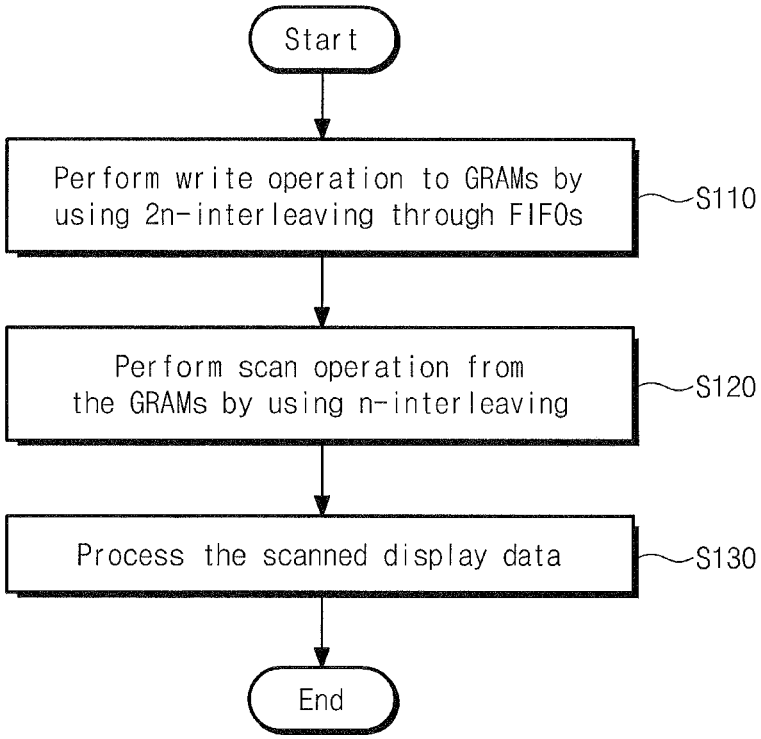
FIG. 12 is a flow chart illustrating a display data processing method according to an exemplary embodiment of the inventive concept.

FIG. 12 is a flow chart illustrating a display data processing method according to an exemplary embodiment of the inventive concept. Below, a display data processing method will be described with reference to FIGS. 1 to 12.

In operation S110, display data 2n-interleaved (n being an integer more than 2) through FIFO memories may be stored in graphic memories. In operation S120, display data stored in the graphic memories may be scanned by an n-interleaving technique. In operation S130, the scanned display data may be processed as predetermined pixel data.

With the display data processing method, display data may be processed in high speed by performing a write operation and a scan operation using an interleaving technique at the same time.

A DDI according to an exemplary embodiment of the inventive concept may not include an arbitration circuit which limits a maximum operating frequency of a graphic memory storing display data and causes an increase in a size of the graphic memory.

With the DDI according to an exemplary embodiment of the inventive concept, a maximum operating frequency of the DDI may increase by adding FIFO memories regardless of an increase in a frequency of input data in a super resolution display of a WXGA (800×1280) display class and a full HD (1080×1920 or 1920×1080) display class.

With the DDI according to an exemplary embodiment of the inventive concept, it is possible to interleave input data of a graphic memory through FIFO memories and it is possible to dispose each memory block to be suitable for a chip size required in terms of a physical layout.

The DDI according to an exemplary embodiment of the inventive concept may reduce current consumed in a display operation through driving at a relatively low speed by changing a clock domain with an 8-interleaving circuit and a FIFO memory.

An exemplary embodiment of the inventive concept may not be limited to a DDI (e.g., MIPI digital command set (DCS) command mode). An exemplary embodiment of the inventive concept is applicable to a structure in which a host (e.g., an application processor) includes a frame buffer for storing image data and a timing controller for processing image data. An exemplary embodiment of the inventive concept is applicable to all devices which include a graphic memory configured to interleave image data and to process the interleaved image data.

Figure 13:
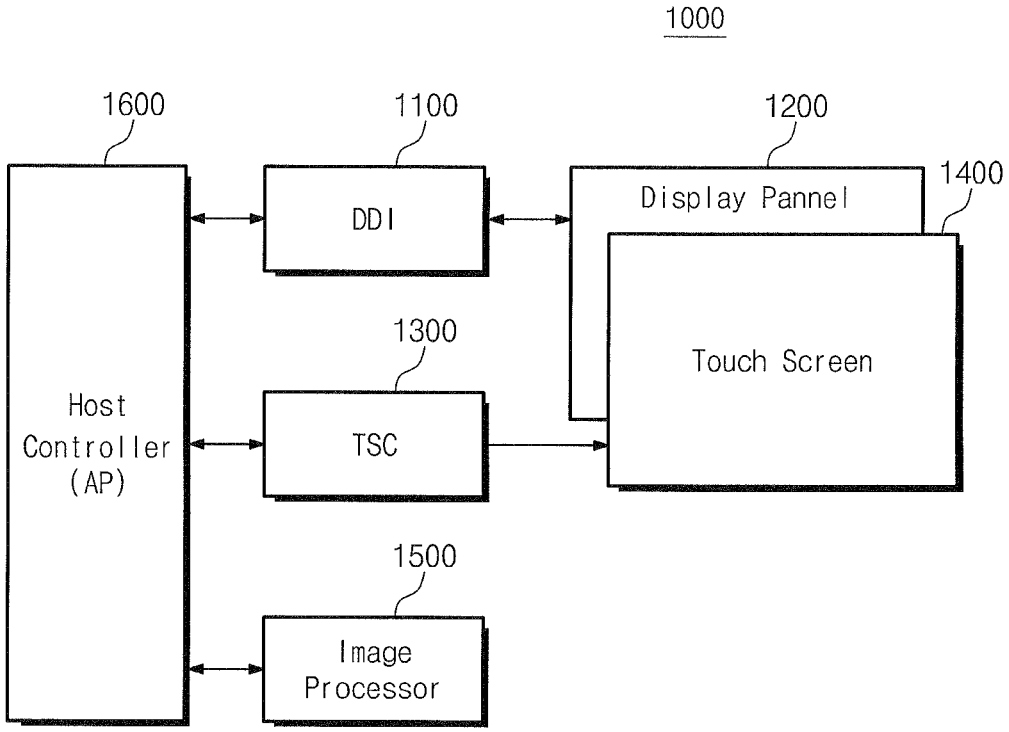
FIG. 13 is a block diagram illustrating a display system according to an exemplary embodiment of the inventive concept.

FIG. 13 is a block diagram illustrating a display system according to an exemplary embodiment of the inventive concept. Referring to FIG. 13, a display system 1000 may include a display driver integrated circuit 1100, a display panel 1200, a touch screen controller 1300, a touch screen 1400, an image processor 1500, and a host controller 1600.

In the display system 1000, the display driver integrated circuit 1100 may be configured to provide display data to the display panel 1200, and the touch screen controller 1300 may be connected to the touch screen 1400 overlapped with the display panel 1200 and configured to receive sense data from the touch screen 1400. The display driver integrated circuit 1100 may be configured to perform a display data processing method according to an exemplary embodiment of the inventive concept described with reference to FIGS. 1 to 12. The host controller 1600 may be an application processor or a graphic card.

The display system 1000 according to an exemplary embodiment of the inventive concept is applicable to a mobile phone (e.g., a Galaxy S, a Galaxy note, an iPhone, etc.), a tablet personal computer (PC) (e.g., a Galaxy Tab, an iPad, etc.), and the like.

Figure 14:
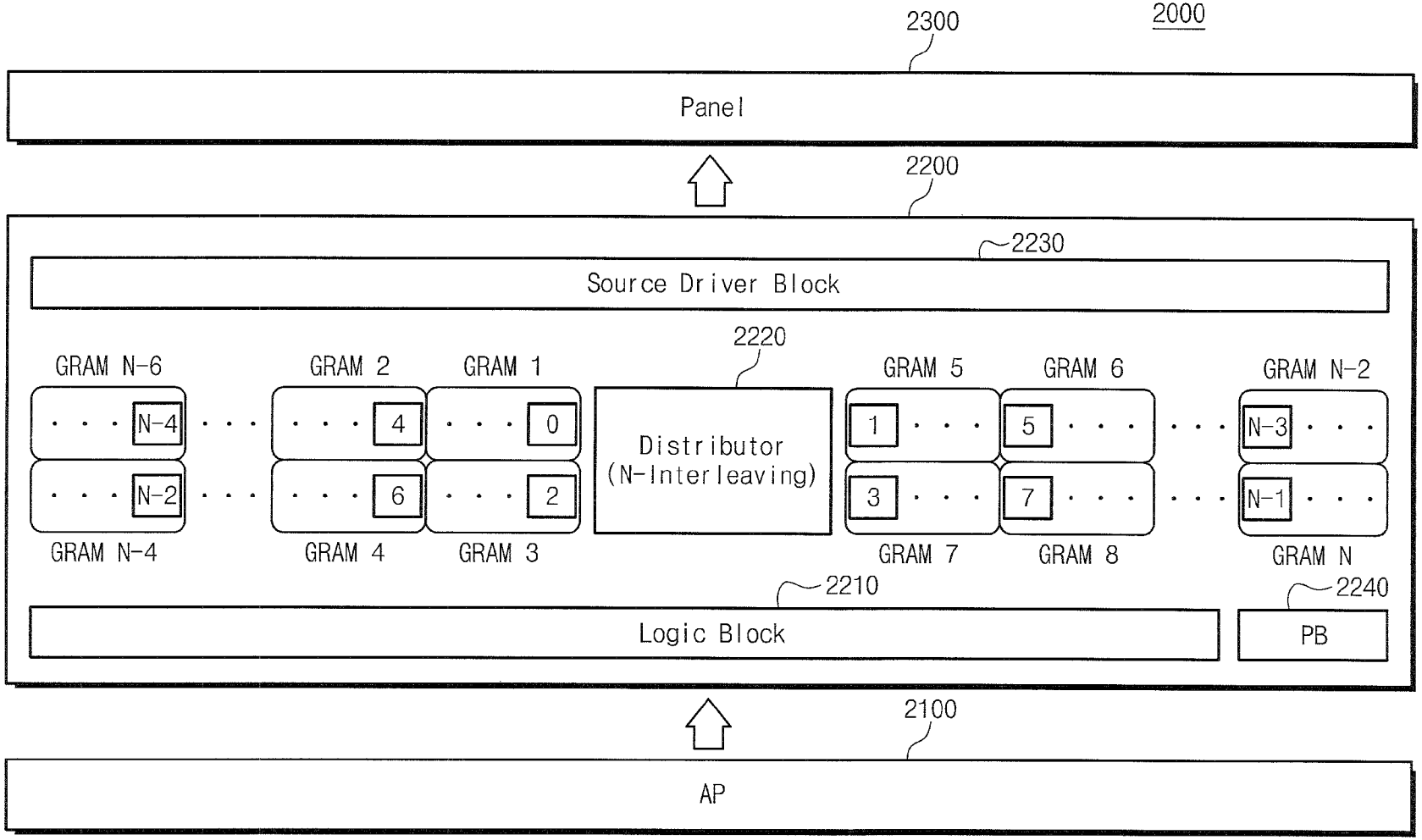
FIG. 14 is a block diagram illustrating a display system according to an exemplary embodiment of the inventive concept.

FIG. 14 is a block diagram illustrating a display system according to an exemplary embodiment of the inventive concept. Referring to FIG. 14, a display system 2000 may include an application processor 2100, a display driver integrated circuit 2200, and a panel 2300. Each of the application processor 2100 and the panel 2300 may be configured the same or substantially the same as the application processor 12 and display panel 16 in FIG. 1.

The display driver integrated circuit 2200 may include a logic block 2210, a distributor 2220, a source driver block 2230, a power block 2240 and graphic memories GRAM 1~GRAM N. The logic block 2210 may control all operation(s) of the display driver integrated circuit 2200. The distributor 2220 may be configured the same or substantially the same as the distributor 120 in FIG. 8B. The source driver block 2230 may receive display data from the graphic memories GRAM 1~GRAM N and transmit the display data to the panel 2300. The power block 2240 may receive a power supply and generate gray voltages corresponding to the display data.

Display data processing methods according to exemplary embodiments of the inventive concept may be stored in at least one microchip/integrated circuit, hardware logic, and memory device which are interconnected through a motherboard, and may be implemented by software or firmware executed by a microprocessor, an ASCI (application specific integrated circuit), an FPGA (field programmable gate array), or a combination thereof.

While the inventive concept has been particularly shown and described with reference to exemplary embodiments thereof, it will be apparent to those of ordinary skill in the art that various changes in form and detail may be made therein without departing from the spirit and scope of the inventive concept as defined by the following claims.

What is claimed is:

1. A display driver integrated circuit (DDI), comprising:

a distributor configured to receive display data at a first frequency of an external clock, to interleave the display data into N (N is an integer greater than 2) and to output the interleaved display data at a second frequency of the external clock, wherein the distributor includes a cache memory or a direct memory access;

a plurality of first-in first-out (FIFO) memories configured to receive all of the interleaved display data from the distributor at the second frequency of the external clock and output all of the interleaved display data at a third frequency of an internal clock; and a plurality of graphics memories configured to receive all of the interleaved display data from the FIFO memories, wherein the second frequency is equal to or higher than a frequency obtained by dividing the first frequency by N, and wherein the second frequency is less than the first frequency.

2. The DDI of claim 1, wherein a frequency of the internal clock is lower than a frequency of the external clock.

3. The DDI of claim 1, wherein the distributor receives the display data at the first frequency.

4. The DIN of claim 3, wherein the interleaved display data is output from the distributor at the second frequency, wherein the second frequency is equal to or greater than the first frequency divided by the number of FIFO memories.

5. The DDI of claim 4, wherein the interleaved display data is output from the FIFO memories at the third frequency, wherein the third frequency is greater than the second frequency and less than the first frequency.

6. The DDI of claim 1, wherein the number of FIFO memories is equal to the number of graphics memories.

7. The DDI of claim 1, wherein the distributor receives the display data via a high speed serial interface.

8. The DDI of claim 1, wherein the distributor receives the display data at a frequency of 1.25 MHz.

9. The DDI of claim 1, further comprising an oscillator configured to generate the internal clock.

10. A display driver integrated circuit (DDI), comprising:

a distributor configured to receive display data at a first frequency of an external clock, to interleave the display data into N (N is an integer greater than 2) and to output the interleaved display data at a second frequency of the external clock and to output the interleaved display data, wherein the distributor includes a cache memory or a direct memory access;

a plurality of first-in first-out (FIFO) memories configured to receive all of the interleaved display data from the distributor and output all of the interleaved display data; and a plurality of graphics memories configured to receive all of the interleaved display data from the FIFO memories in response to an internal clock and output all of the interleaved display data in response to the internal clock, wherein the second frequency is equal to or higher than a frequency obtained by dividing the first frequency by N, and wherein the second frequency is less than the first frequency.

11. The DDI of claim 10, wherein the interleaved display data is received at the graphics memories according to a write enable signal at a rising edge of the internal clock.

12. The DDI of claim 11, wherein the interleaved display data is output from the graphics memories according to a scan enable signal at a falling edge of the internal clock.

13. The DDI of claim 12, further comprising a timing controller configured to control the write enable signal and the scan enable signal.

14. The DDI of claim 10, wherein a frequency at which the interleaved display data is received at the graphics memories is the same as a frequency at which the interleaved display data is output from the graphics memories.

15. The DDI of claim 10, wherein the interleaved display data is received by the FIFO memories using the external clock and the interleaved display data is output from the FIFO memories in response to the internal clock.

16. The DDI of claim 15, wherein a frequency of the internal clock is lower than a frequency of the external clock.

17. The DDI of claim 10, wherein the graphics memories do not include arbitration circuits.

18. The DDI of claim 10, further comprising an oscillator configured to generate the internal clock.

19. The DDI of claim 10, wherein each of the graphics memories has a corresponding FIFO memory.

20. A display driver integrated circuit (DDI), comprising:

a distributor configured to receive display data at a first frequency of an external dock, to interleave the display data into N (N is an integer greater than 2) and to output the interleaved display data at a second frequency of the external clock and to output the interleaved display data, wherein the distributor includes a cache memory or a direct memory access;

a plurality of first-in first-out (FIR)) memories configured to receive the interleaved display data from the distributor; and a plurality of graphics memories configured to receive the interleaved display data from the FIFO memories, wherein FIFO memory pairs each share a data line with a corresponding graphics memory pair, wherein the FIFO memories receive the interleaved display data from the distributor using the external clock and output the interleaved display data in response to an internal clock, and the graphics memories scan out the interleaved display data under control of a scan controller operative in response to the internal clock, wherein the second frequency is equal to or higher than a frequency obtained by dividing the first frequency by N, and wherein the second frequency is less than the first frequency.

21. The DDI of claim 20, wherein the FIFO memories receive the interleaved display data from the distributor at the second frequency and output the interleaved display data via the data lines at a third frequency, wherein the third frequency is greater than the second frequency.

22. The DDI of claim 20, wherein the graphics memories receive the interleaved display data from the FIFO memories in response to the internal clock.

23. A data processing method of a display driver integrated circuit, comprising:

receiving display data at a first frequency of an external clock;

interleaving display data into N (N is an integer greater than 2);

outputting the interleaved display data at a second frequency of the external clock;

writing the interleaved display data from a distributor to a plurality of first-in first-out (FIFO) memories using the external clock;

writing of the interleaved display data from the FIFO memories to a plurality of graphics memories in response to an internal clock; and scanning the interleaved display data of the graphics memories to an image data processing block in response to the internal clock, wherein the second frequency is equal to or higher than frequency obtained by dividing the first frequency by N, and wherein the second frequency is less than the first frequency.

* * * * *